US007467670B2

(12) United States Patent
Hartke et al.

(10) Patent No.: US 7,467,670 B2
(45) Date of Patent: Dec. 23, 2008

(54) METHOD AND APPARATUS FOR INDEXING BETWEEN SELECTED COLUMNS IN A DRILL ROD MAGAZINE

(75) Inventors: Louis Carl Hartke, Otley, IA (US); Eric Steinhart, Runnels, IA (US)

(73) Assignee: Vermeer Manufacturing Company, Pella, IA (US)

( * ) Notice: Subject to any disclaimer, the term of this patent is extended or adjusted under 35 U.S.C. 154(b) by 207 days.

(21) Appl. No.: 11/524,731

(22) Filed: Sep. 20, 2006

(65) Prior Publication Data

US 2008/0066964 A1 Mar. 20, 2008

(51) Int. Cl.
*E21B 19/20* (2006.01)

(52) U.S. Cl. ..... 175/52; 175/85; 414/22.62

(58) Field of Classification Search ..... 175/52, 175/85; 414/22.62, 745.9, 746.4
See application file for complete search history.

(56) References Cited

U.S. PATENT DOCUMENTS 5,556,253 A 9/1996 Rozendaal et al.
5,607,280 A * 3/1997 Rozendaal ..... 414/745.7
6,085,852 A * 7/2000 Sparks et al. ..... 175/52
6,332,502 B1 12/2001 Mills et al.
6,360,830 B1 * 3/2002 Price ..... 175/52
6,474,931 B1 11/2002 Austin et al.
6,543,551 B1 * 4/2003 Sparks et al. ..... 175/52
6,814,164 B2 11/2004 Mills et al.
6,845,825 B2 * 1/2005 Bischel et al. ..... 175/24
6,969,222 B1 * 11/2005 Koch ..... 414/22.51
7,240,742 B2 * 7/2007 Sewell et al. ..... 175/52
2002/0079137 A1 * 6/2002 Mills et al. ..... 175/52
2002/0153169 A1 * 10/2002 Sewell ..... 175/52
2004/0022605 A1 * 2/2004 Anthis et al. ..... 414/22.53
2004/0129455 A1 * 7/2004 Koch et al. ..... 175/52

* cited by examiner

*Primary Examiner*—Hoang Dang
(74) *Attorney, Agent, or Firm*—Merchant & Gould PC

(57) ABSTRACT

Mechanical stops are utilized on a rod transfer mechanism, with the stops being offset vertically from one another, to index the rod transfer mechanism of an HDD machine under the appropriate column of a drill rod storage magazine. The stops engage a moveable block which is moved by the operator using a block position selector device. The stops are arranged such that each stop corresponds to a respective column of the magazine. Accordingly, the rod transfer mechanism moves transversely away from the longitudinal axis of the drill string until the selected stop engages the block. The block position selector device is preferably located at the HDD machine operator's station. A cable slidably received within a jacket is employed between the position selector and the block to raise and lower the block.

17 Claims, 6 Drawing Sheets

METHOD AND APPARATUS FOR INDEXING BETWEEN SELECTED COLUMNS IN A DRILL ROD MAGAZINE

FIELD OF THE INVENTION

The present invention relates generally to equipment used for ground boring; more specifically to a method and apparatus associated with manipulating drill rod used in drilling; and more particularly still to a method and apparatus for indexing drill rod loading mechanisms between columns in a drill rod magazine mounted on a horizontal directional drilling machine.

BACKGROUND OF THE INVENTION

Horizontal directional drilling, commonly referred to as HDD, is a process used in a number of applications such as installing utilities underground. The HDD process, regardless of the application, includes a pilot hole-boring step. In this step a bore hole is created that extends underground—generally horizontal or parallel to the surface of the earth—starting at a launch point and ending at a termination point.

The bore hole is created by positioning a boring machine to rotate and push a drill string through the ground. A drill bit is attached to the leading end of the drill string. The drill string is created by connecting individual drill rods together end-to-end from a supply of drill rods stored on the boring machine. The connection between the rods is made up, and subsequently broken in a later step, by the boring machine. A typical boring machine includes a gearbox that connects to the drill string, a drill rod storage magazine, and a rod loading mechanism. The rod loading mechanism moves the individual drill rods from the storage magazine into alignment with the drill string and the gearbox where the individual drill rod is connected to and made a part of the drill string.

Rod loading mechanisms typically include a rod transfer mechanism that moves the rod from the storage magazine and positions the rod with one end in alignment with the drill string and the other end in alignment with the gearbox. Typically, when the drill rod is not being used as part of the drill string, it is stored in a plurality of columns within the storage magazine. In many of these systems, the drill rod is removed sequentially from the first column of the storage magazine proximal to the drill string. After the first, proximal column is emptied, then drill rod is taken from the next adjacent column. Depending on the number of drill rods required for the application, the drill rod is removed column by column until the most distal column is emptied. When the drill string is later broken down, the reverse procedure is utilized, whereby the most distal column is filled first, with next closer adjacent column filled next, and continuing until the proximal column is filled.

The above method is especially used with rod transfer mechanisms that employ a single rod blocking member, with a rod receiving pocket, or grip, located proximal the drill string. The rod receiving pocket may be located physically adjacent the rod blocking member or may be part of the same structure. In either event, however, if the rod receiving pocket is indexed past a column that is not yet emptied, then the drill rod from that column is unintentionally released into the drill string area. Since the drill rod is generally both long and heavy, drilling must cease until the drill rod is untangled and removed from the drill string area. This creates an inefficient and aggravating situation.

In order to insure that the rod transfer mechanism is properly indexed to the appropriate column, mechanical stops have been employed in the past. However, to set the stops to the correct index position, the operator needed to stop drilling, leave the operator position, move to the magazine area, and then manually set the stop. Alternatively, a second person needed to set the position. In either instance the process was inefficient. Therefore, there is a need in the art for a method and apparatus for efficiently and correctly setting the index position for the appropriate column of a drill rod magazine of an HDD machine from the operator position. The present invention overcomes the shortcomings of the prior art and addresses these needs in the art.

SUMMARY OF THE INVENTION

The present invention generally relates to a method and apparatus for properly indexing the rod transfer mechanism of an HDD machine to position the rod receiving pocket under the appropriate column of the drill rod storage magazine. Mechanical stops are utilized on the rod transfer mechanism, with the stops being offset from one another. The stops engage a moveable block which is moved by the operator using a block position selector device.

As the selector device is actuated, the block moves between stop positions. For each selector device position, the block is aligned with one of the stops. Further, the stops are arranged such that each stop corresponds to a respective column of the magazine. Accordingly, the rod transfer mechanism moves transversely away from the longitudinal axis of the drill string until the selected stop engages the block. In this manner, the rod receiving pocket is located beneath the appropriate column, and the column is emptied of drill rod before moving the block to the next column position.

The block position selector device is preferably located at the HDD machine operator's station. The selector device enables the operator to select the appropriate column of the magazine. This is accomplished functionally by the selector device arranged and configured to physically move the block in discrete increments to the appropriate positions corresponding to the offset stops. In the preferred embodiment, a cable slidably received within a jacket is employed between the position selector and the block to move the block.

One aspect of the invention relates to the ergonomic and positive manner in which the selector device operates. More specifically, in one preferred embodiment, the stops are offset vertically and the moveable block is spring biased toward its upward most position. This requires a force to be applied to a pivoting lever of the selector device in order to move the lever (and, correspondingly, the block) to a position other than the first column. Additionally, a first handle is included on the distal end of the lever (e.g., the end away from the pivot point of the lever) and a biased latch is attached to the lever. The biased latch includes a pin biased into engagement with one of a plurality of pockets visible within a selector window. The location of the pockets in the window provide a sure visual representation to the operator of the column from which the drill rod will be selected. Further, because the lever includes the latch, the lever cannot inadvertently move (and thus the block cannot move) to an unwanted column.

In operation, the operator selects the appropriate column by lifting the spring biased latch on the lever (e.g., by moving a second handle attached to the biasing latch toward the first handle at the distal end of the lever). This lifts the pin out of the current engagement pocket such that the operator can then move the lever to the desired column. Releasing the spring biased latch then lowers the pin into the newly selected pocket. As the lever is moved, the block is raised (or lowered depending on the direction of movement of the lever) so as to engage a different stop. This in turn selects the column in the magazine.

Therefore, according to one aspect of the invention, there is provided a drill rod handling system, comprising: a drill rod storage magazine, wherein the drill rod is stored in a plurality of columns; a rod transfer mechanism, the rod transfer mechanism including a plurality of stops, the stops being offset from one another and each of which are positioned such that the rod transfer mechanism unloads drill rod from one of the columns; and a moveable block which selectively engages one of the stops, wherein the moveable block is positioned into alignment with a stop to select drill rod from a desired column.

According to further aspects in accordance with the foregoing paragraph, there is provided: a mechanical linkage connected to the moveable block, the mechanical linkage moving the moveable block based on a selected position; a plurality of selection positions corresponding to the columns; and a selection lever and a biased latch, the biased latch engaging a selection position, whereby the mechanical linkage cannot move between selection positions until the biased latch activated.

According to another aspect of the invention, there is provided a horizontal directional drilling machine, comprising: a drill rod storage magazine having a plurality of generally vertical columns; a boring assembly defining a drill string axis comprising a rack frame with an upper end and a lower end, a gearbox configured to travel along the rack frame from the upper end to the lower end, and a vise assembly a the lower end; a drill rod transfer mechanism configured to move transversely relative to the drill string axis to receive drill pipe from the storage magazine; an operator station; a plurality of stops mounted on the drill transfer mechanism, the plurality of stops being offset from one another and each of which are positioned such that the rod transfer mechanism unloads drill rod from one of the vertical columns; and a moveable block which selectively engages one of the stops, wherein the moveable block is positioned into alignment with a stop to select drill rod from a desired vertical column.

According to yet another aspect of the invention, there is provided a method for selecting a desired column of a drill rod magazine having a plurality of columns, the magazine of the type utilized on a horizontal directional drilling machine where a drill rod transfer mechanism moves the drill rod from the desired column to a drill string, the method comprising: affixing a plurality of stops on the rod transfer mechanism; locating a moveable block between a number of positions, wherein one stop is engaged in each position; connecting a mechanical linkage to move the block to the desired position.

The invention may also be employed in other environments which utilize drill rod storage locations, columns, rows and/or magazines. For example, the principles of the present invention may be employed in connection with vertical drilling devices. Also, the invention is not limited to use with single blocking member rod transfer mechanisms. For example, the principles of the present invention may be employed with rod transfer mechanisms which can select drill rod from a desired column while blocking the remaining columns.

While the invention will be described with respect to preferred embodiment configurations and with respect to particular devices used therein, it will be understood that the invention is not to be construed as limited in any manner by either such configuration or components described herein. Also, while the particular types of transfer mechanisms are described herein, it will be understood that such particular mechanisms are not to be construed in a limiting manner. Instead, the principles of this invention extend to any environment in which selection of a row or column in a drill rod magazine or other drill rod storage location is desired. These and other variations of the invention will become apparent to those skilled in the art upon a more detailed description of the invention.

The advantages and features which characterize the invention are pointed out with particularity in the claims annexed hereto and forming a part hereof. For a better understanding of the invention, however, reference should be had to the drawings which form a part hereof and to the accompanying descriptive matter, in which there is illustrated and described a preferred embodiment of the invention.

DETAILED DESCRIPTION OF THE PREFERRED EMBODIMENT

Reference will now be made in detail to exemplary aspects of the present invention which are illustrated in the accompanying drawings. Wherever possible, the same reference numbers are used throughout the drawings to refer to the same or like parts.

Figure 1:
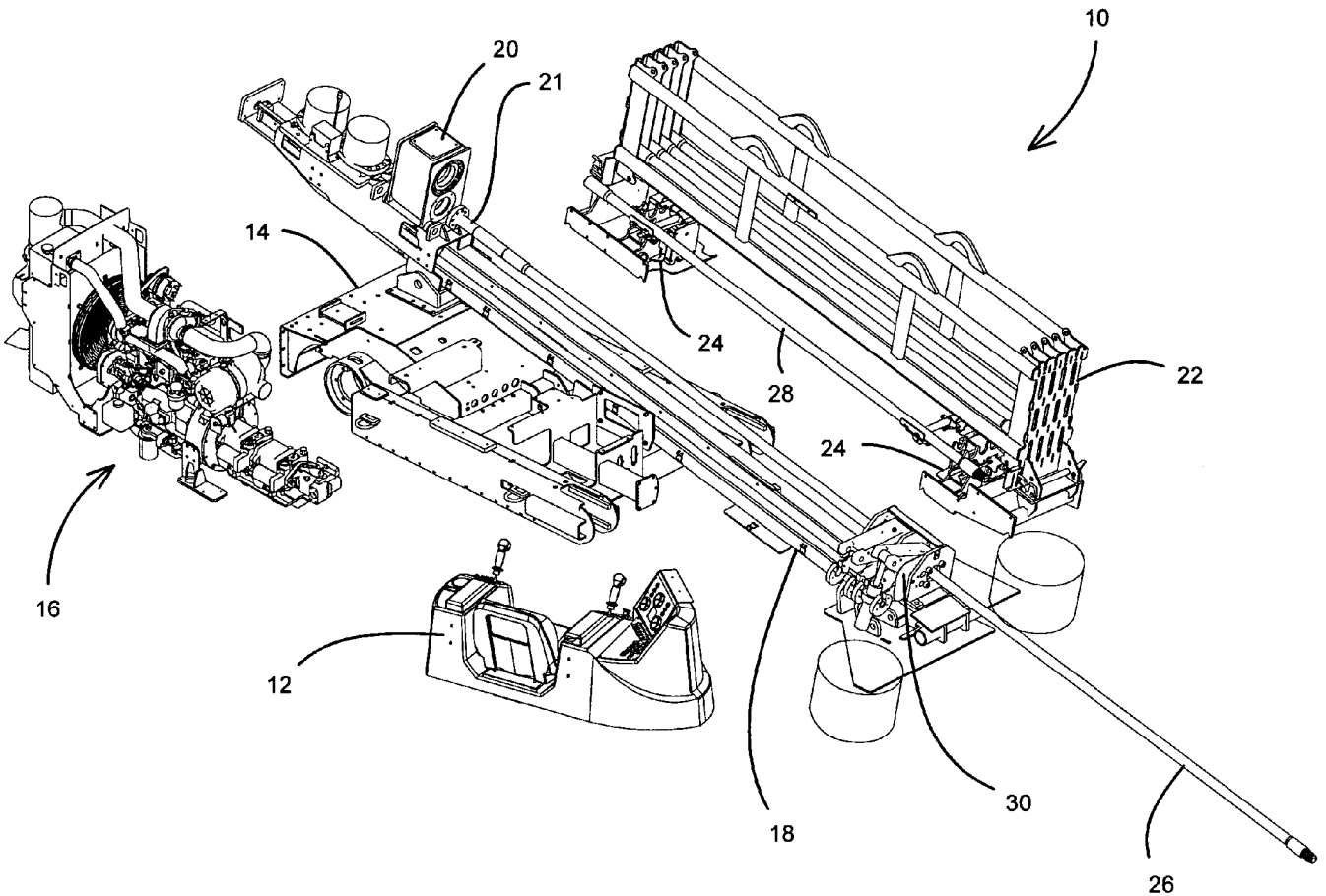
FIG. 1 is an exploded perspective view illustrating the basic components of a horizontal directional drill device.

FIG. 1 illustrates a typical horizontal directional drill 10 including an operator console 12, a main frame 14, a power supply 16 (e.g., a prime mover), a rack frame 18, a gearbox 20 that is arranged and configured to move back and forth along the longitudinal axis of the rack frame 18. Spindle 21 can be independently rotated clockwise or counterclockwise. A rod magazine 22 located generally above and to the side of the rack frame 18 stores drill rods 28. Pipe transfer mechanism 24 is arranged and configured to move the drill rod from the magazine 22 to a position in line with the drill string 26. Pipe transfer mechanism 24 has an upper and a lower assembly—with one assembly located at each end of the magazine 22. As used herein, the term lower refers to a position closer/nearer to the surface of the ground, while upper refers to a position that is relatively further from the ground. A vise assembly 30 is located proximate the lower pipe transfer mechanism 24. Accordingly, in operation, the pipe transfer mechanisms select and transfer individual drill rod 28 from the magazine 22 and into alignment with the drill string 26 and spindle 21 of gearbox 20.

It will be appreciated that the drill rod 28 is referred to herein as both drill rod and drill pipe. Such terms are used interchangeably herein and are not meant to denote a different type of work piece or structure.

Figure 2:
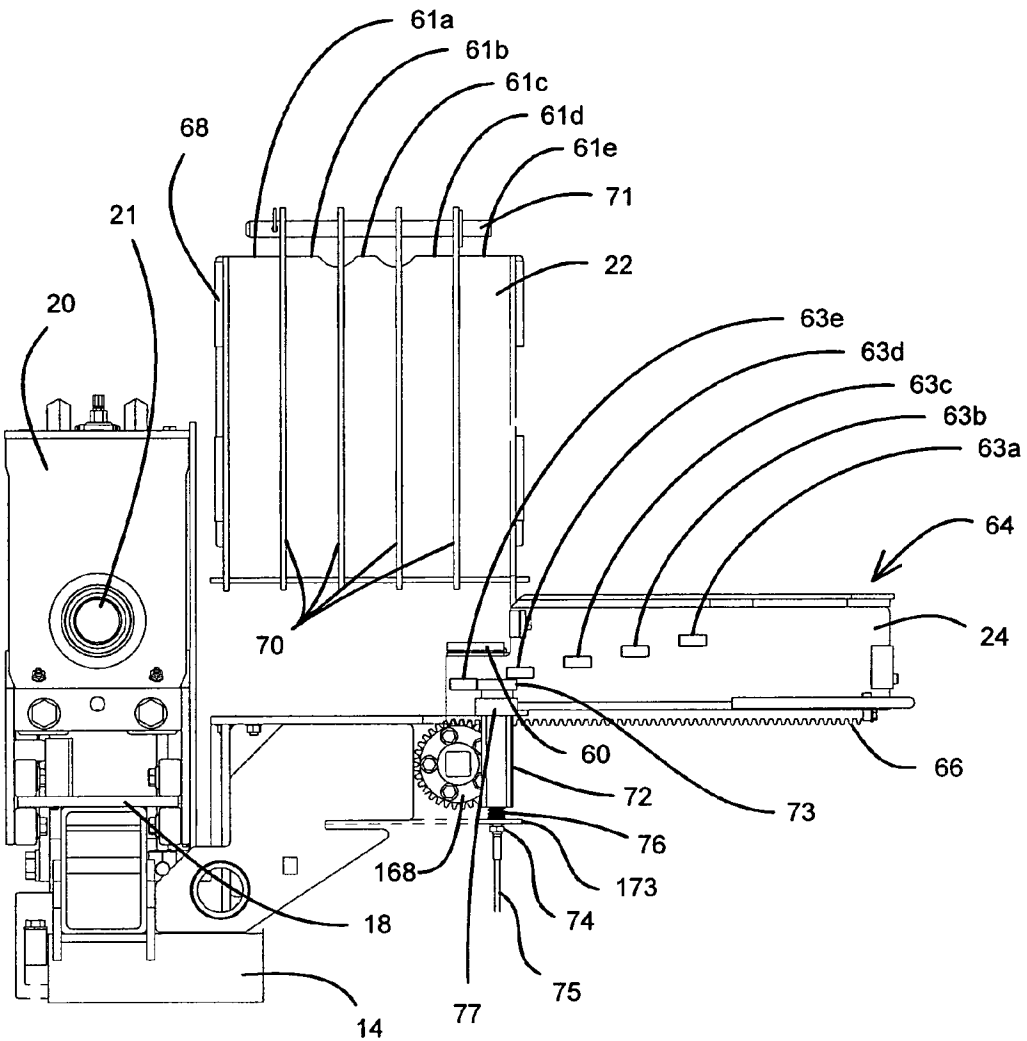
FIG. 2 is a section view through a drill rod magazine and a portion of the HDD machine, including the drill rod transfer device.

Now turning to FIG. 2, one of the pipe transfer mechanisms 24, the magazine 22, the rack frame 18, the spindle 21 and the gearbox 20 are illustrated. In FIG. 2, the pipe transfer mechanism 24 is shown positioned with the rod pocket 60 located directly beneath rod column 61*e*. This column 61*e* is most distal from the drill string 26 (which is in-line with the spindle 21 in FIG. 2). Column 61*a* is most proximal to the drill string 26 with each adjacent column 61*b*, 61*c*, and 61*d* moving progressively further away from the drill string 26. A plurality of stops 63*a*-63*e* are included on the pipe transfer mechanism 24. The stops 63*a*-63*e* are arranged in a horizontal and vertical offset from one another (e.g., arranged in a pattern resembling a "stair-step"). Those of skill in the art will appreciate that other patterns and physical locations relative to one another may be used for the stops.

The transfer mechanism 24 includes rod pocket 60 at a first end of the mechanism, and a rod blocking member 64 extending from the rod pocket 60 to the second end of the mechanism. It will be appreciated however, that the rod blocking member 64 may be arranged and configured to other lengths in order to provide the function of blocking drill pipe 28 from exiting non-selected columns of the magazine 22. On the lower side of the mechanism is a gear rack 66 which is engaged by a driven gear 68. Movement of the driven gear 68 moves the transfer mechanism 64 back and forth under the magazine and transversely relative to the longitudinal axis of the drill string 26. By driven, what is meant is that the gear is powered in a manner by which the gear rotates with enough force to move the transfer mechanism. A hydraulic fluid motor (not shown) may be used to drive the gear 68, with the hydraulic fluid motor powered by a hydraulic pump connected to the power supply 16 (best seen in FIG. 1). A pressure limiting device is preferably utilized in connection with the hydraulic pump as will be described in more detail below. The mechanism 24 is supported on the frame 14 with suitable bushings or bearings (not shown).

As noted above, the magazine 22 includes a plurality of columns 61*a*-61*e* in which drill rod 28 is stored when not connected to the drill string 26. The magazine 22 may include a bar 71 at each end for lifting the magazine 22 with a front end loader, crane or other suitable lift assisting device. The bar 71 may provide additional functionality of retaining drill rods 28 within the magazine 22 if the magazine is stored on its side and/or is inadvertently placed or dropped in that position. The columns 61*a*-61*e* are formed with outer walls 68 and inner walls 70. The drill rod 28 is generally placed within the columns 61*a*-61*e* (best seen in FIG. 1), and gravity is utilized to lower the drill rod 28 within the respective columns to a position where the drill rod 28 drops into the rod pocket 60 when the particular column is selected.

The rod pocket 60 is preferably selected to be a distance from the bottom of the magazine 22 such that only one drill rod 28 is released from the column at a time. However, other drill rod 28 blocking mechanisms may be employed. For further details on the operation and structure of a transfer mechanism 24, reference may be had, for example, to U.S. Pat. No. 6,814,164, to Mills et al., and titled Pipe Loading Device For A Directional Drilling Apparatus and to U.S. Pat. No. 5,556,253, to Mills et al., and titled Automatic Pipe-Loading Device, each of which are assigned to the assignee hereof. Such patents are hereby incorporated herein and made a part hereof.

Figure 3:
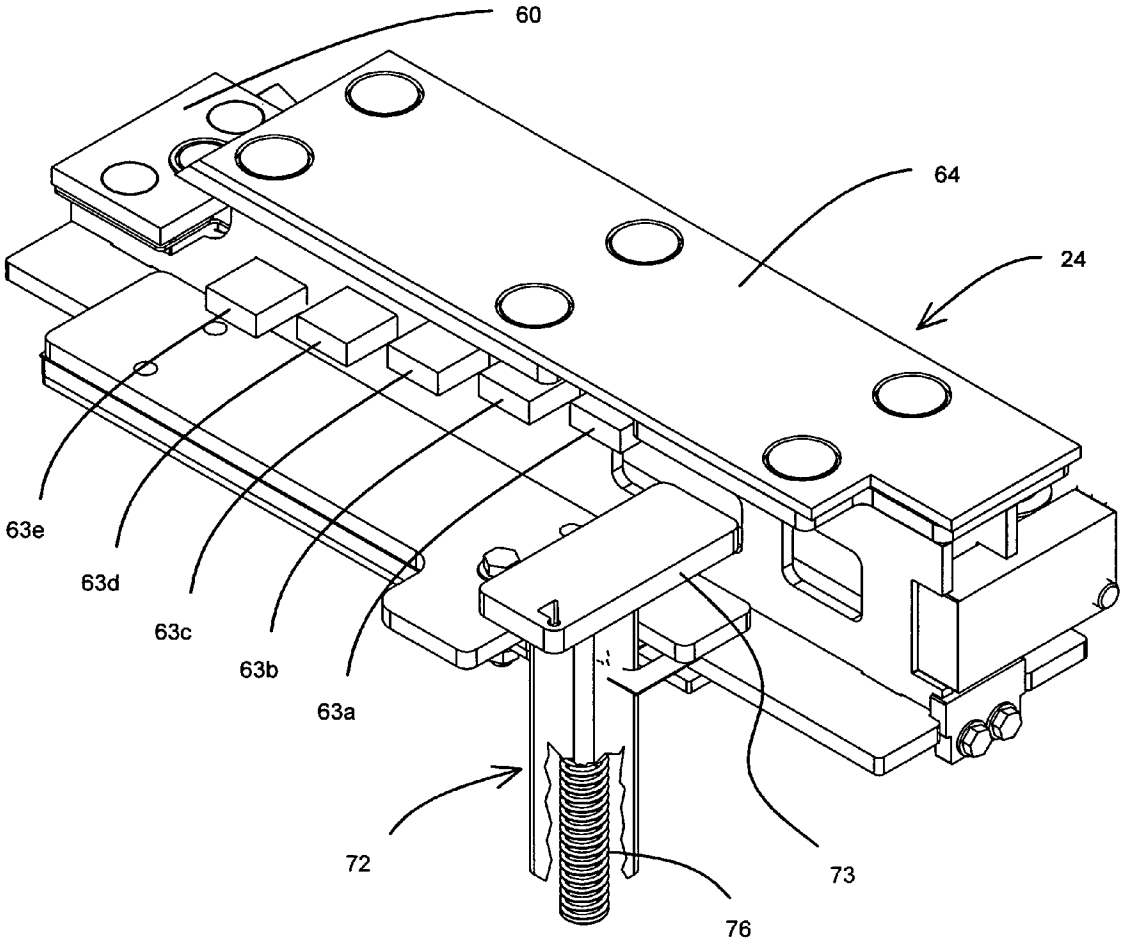
FIG. 3 is an enlarged view of the drill rod transfer device illustrating the moveable block and the vertically and horizontally offset stops.

Referring now to FIGS. 2 and 3, moveable block device 72 is mounted on frame 14 at flange 73. A threaded extent is located through the flange 73 and frame 14. One or more barrel nuts 74 secures the jacket 75 in place. A cable slides within the jacket 75 and a second end of the cable is connected to a first end of the moveable block 72. Spring 76 applies an upward force on the moveable block 72 away from the flange 74. The moveable block 72 is limited to reciprocating movement by bushing 77.

Figure 4A:
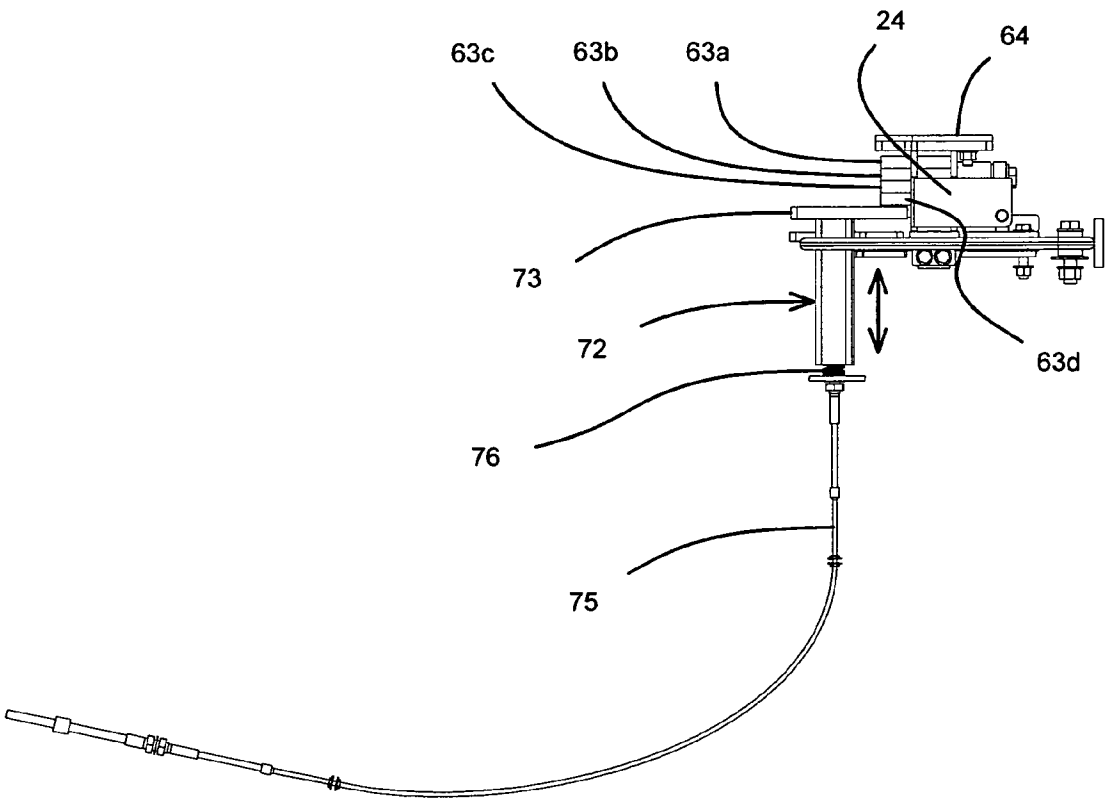
FIG. 4*a* is a schematic view of the block position selector device in a first position with the moveable block lowered.
Figure 4A:
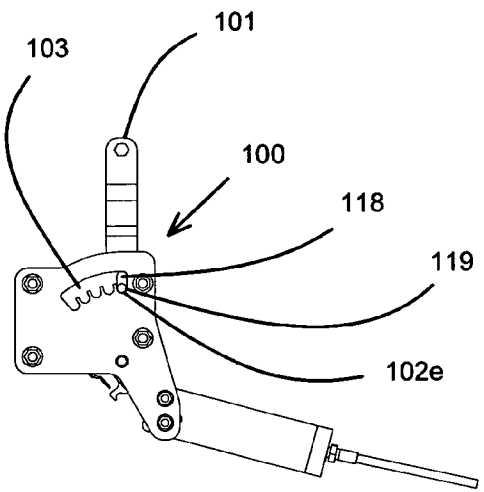
Figure 4B:
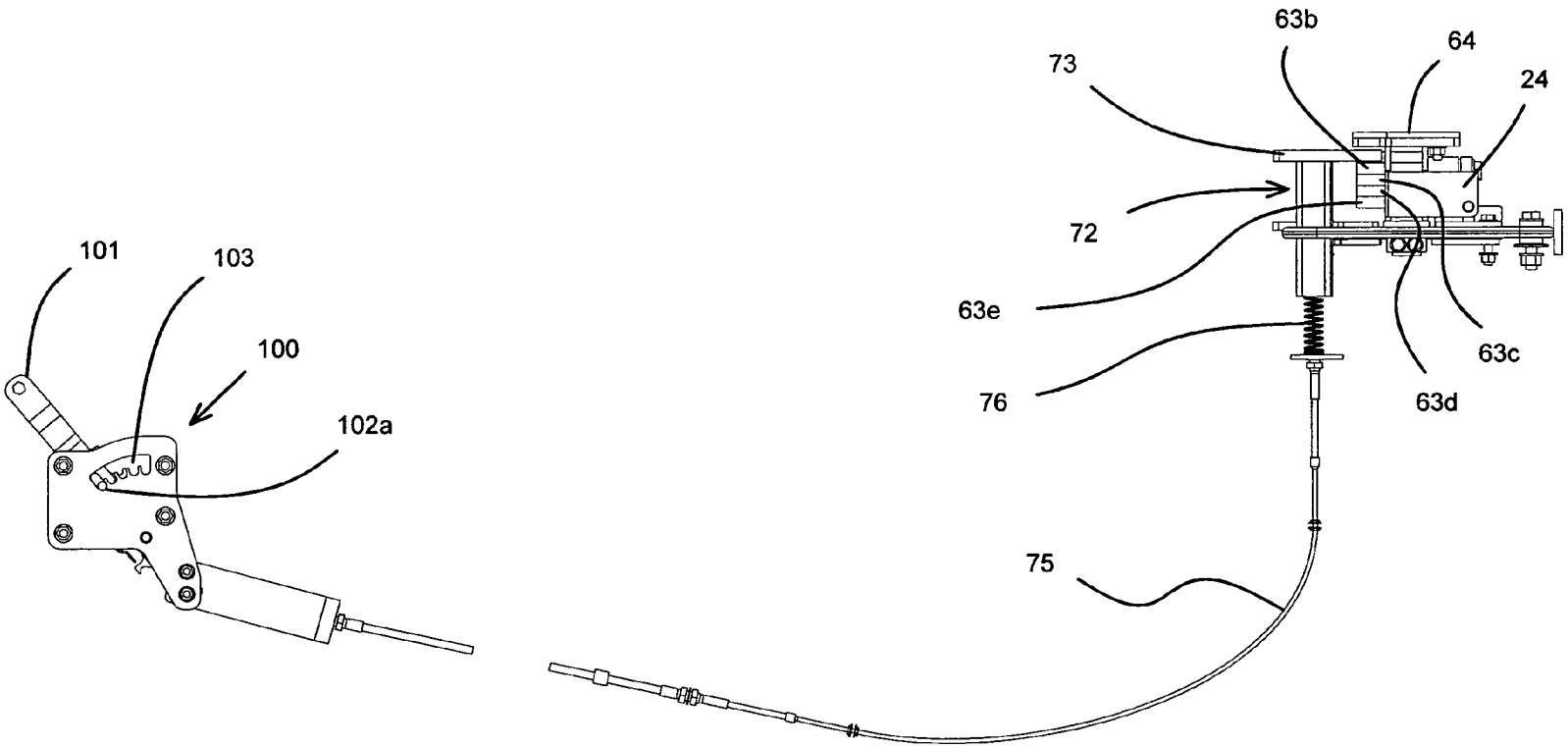
FIG. 4*b* is a schematic view of the block position selector device in a second position with the moveable block raised.
Figure 5:
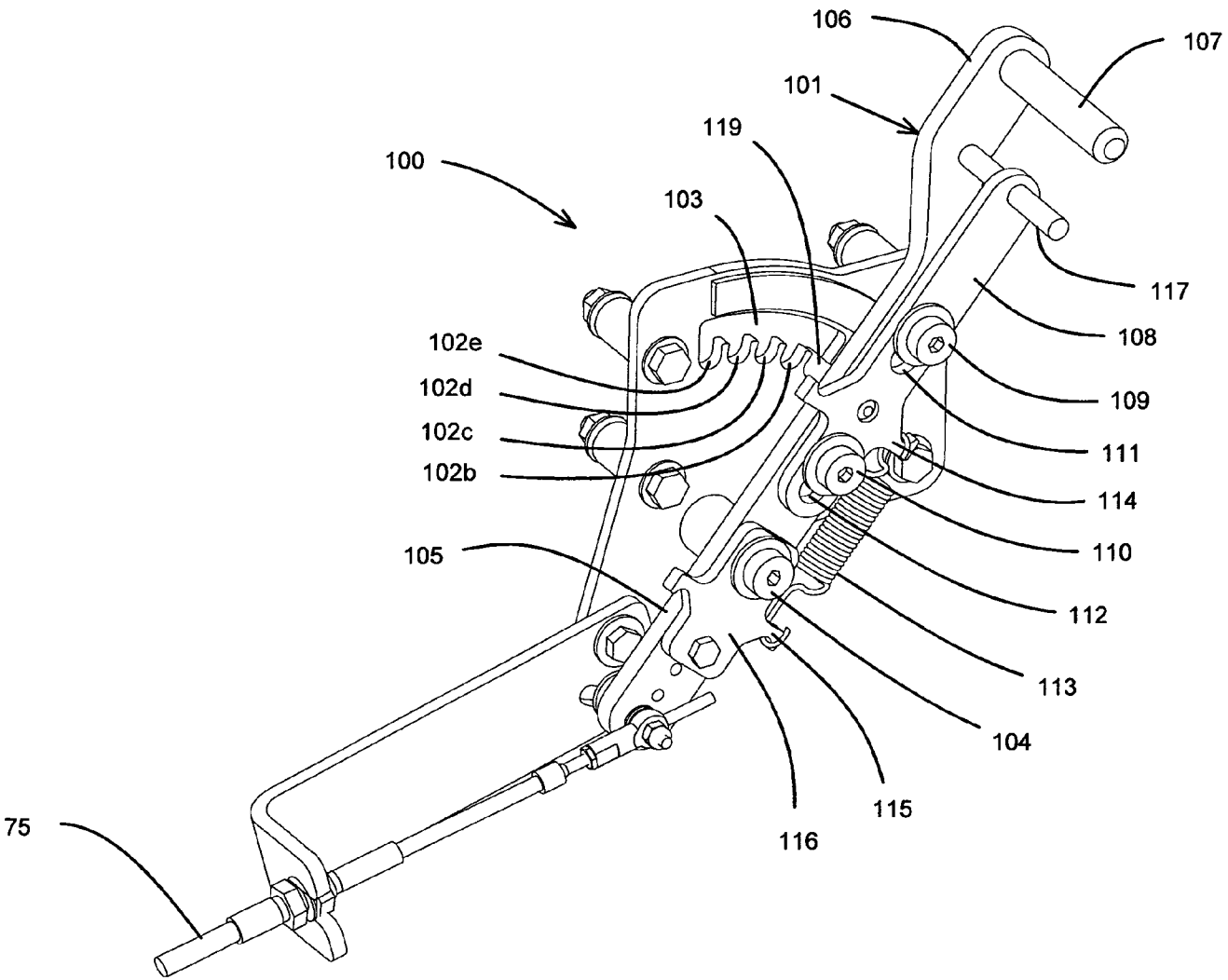
FIG. 5 is a perspective view of the lever and latch device on the block position selector device.

The first end of the cable is connected to the block position selector device 100 (best seen in FIGS. 4*a*, 4*b* and 5). Preferably the cable is rigid so that it can operate in both a push and pull mode. However, with use of spring 76, the cable can be a non-rigid wire which is utilized in a pull mode. In this case, spring 76 provides the motive force for the cable to travel through the jacket in the opposition direction when desired.

As the cable is pulled toward the operator station (e.g., toward the block position selector device 100), the moveable block 72 moves downward. A second end of the moveable block is arranged and configured to engage the stops 63*a*-63*e*, wherein one of the stops is engaged in any selected position. When the transfer member 24 moves away from the drill string 26 by means of the powered gear 68, the stop 63*a*-63*e* appropriate for the selected column 61*a*-61*e* contacts the second end of the moveable block 72. At that time, the pressure limiting device associated with the powered gear 68 causes the transfer member 24 to stop its movement. Such pressure limiting device can act to direct all hydraulic fluid away from the hydraulic fluid motor when a certain pressure is reached (e.g., when one of the stops 63*a*-63*e* engages the moveable block 72) and/or the pressure limiting device can shunt hydraulic fluid around the hydraulic fluid motor to limit the force the exerted. Other pressure limiting solutions may also be utilized to provide the function of limiting the force applied to the moveable block 72 by the stop 63.

It will be appreciated that the selected column in FIG. 2 is column 61*e* (e.g., the most distal column), and so stop 63*e* is illustrated as engaging the second end 73 of the moveable block 72. In the preferred embodiment, this position of the moveable block 72 is associated with the most lowered position of the moveable block 72 and a fully compressed spring 76. However, it will be appreciated that other positions of the moveable block 72 may be employed for the most distal column and the spring 76 may be employed in some other positions as a matter of design choice.

FIGS. 4*a* and 4*b* provide an end view of the transfer mechanism 24 with the moveable block 72 in a lowermost position in FIG. 4*a* (e.g., to select column 61*e*) and an uppermost position in FIG. 4*b* (e.g., to select column 61*a*). Also shown in FIGS. 4*a* and 4*b* is the relative position of the lever 101 of selector device 100 when the moveable block 72 is in different positions. The selector lever 101 is engaged with pocket 102*e* in FIG. 4*a* and is engaged with pocket 102*a* in FIG. 4*b*.

FIG. 5 illustrates the selector device 100 in more detail. Selector lever 101 pivots about point 104 at its first end. Handle 107 is located at second end 106. Threaded bosses 109 and 110 are located between the first and second end of selector lever 101. Spring biased latch device 108 is slidably mounted on selector lever 101 with bosses 109 and 110 extending through elongated channels 111 and 112, respectively. Nuts, welded attachments or other securing devices may be utilized to retain the spring biased latch device onto selector lever 101. Spring 113 biases the biased latch device 108 toward the second end 105 of the selector lever 101. Spring 113 attaches between arm 114 located on the biased latch device 108 and arm 115 located on third member 116. Third member 116 is fixed to the pivot point 104 and the second end 105 of lever arm 101. Handle 117 is located on biased latch device 108. Boss or pin 119 (best seen in FIGS. 4*a* and 4*b*) is connected to biased latch device 108 and extends through an elongated channel in selector lever 101. Pin 119 is thereby normally biased into engagement with a pocket 102*a*-

102*e*. However, when handle 117 is moved in a direction toward first end 106 of selector lever 101, then the pin 119 moves out of engagement with a pocket 102, and the selector lever 101 can be moved between pockets 102 within window 103. Movement of the selector lever 101 moves the cable within jacket 75. Preferably handle 117 is physically located in a location where an operator can simultaneously grasp handles 107 and 117 in order to move handle 117 closer to handle 107 against the force of spring 113.

As noted above, the present invention may be employed in environments other than HDD which utilize drill rod storage locations, columns, rows and/or magazines. For example, the principles of the present invention may be employed in connection with vertical drilling devices. Accordingly, the term column is used to denote a column, row or other collection of drill rod arranged in a line. Also, the invention is not limited to use with single blocking member rod transfer mechanisms. For example, the principles of the present invention may be employed with rod transfer mechanisms which can select drill rod from a desired column while blocking the remaining columns. In this case, the columns are not necessarily emptied of drill rod in order.

While particular embodiments of the invention have been described with respect to its application, it will be understood by those skilled in the art that the invention is not limited by such application or embodiment or the particular components disclosed and described herein. It will be appreciated by those skilled in the art that other components that embody the principles of this invention and other applications therefor other than as described herein can be configured within the spirit and intent of this invention. The arrangement described herein is provided as only one example of an embodiment that incorporates and practices the principles of this invention. Other modifications and alterations are well within the knowledge of those skilled in the art and are to be included within the broad scope of the appended claims.

We claim:

1. A drill rod handling system, comprising:

a) a drill rod storage magazine, wherein the drill rod is stored in a plurality of columns;

b) a rod transfer mechanism, the rod transfer mechanism including a plurality of stops, the stops being offset from one another and each of which are positioned such that the rod transfer mechanism unloads drill rod from one of the columns; and c) a moveable block which selectively engages one of the stops, wherein the moveable block is positioned into alignment with a stop to select drill rod from a desired column.

2. The drill rod handling system of claim 1, wherein there is one stop corresponding to each column.

3. The drill rod handling system of claim 2, wherein the stops are offset vertically from one another.

4. The drill rod handling system of claim 3, wherein the moveable block moves between vertically offset positions such that it is aligned with one of the stops in each of its positions.

5. The drill rod handling system of claim 4, wherein the rod transfer mechanism includes two generally opposing transfer arms, with one transfer arm located at each end of the drill rod, and wherein stops are located on one of the transfer arms.

6. The drill rod handling system of claim 1, further comprising a mechanical linkage connected to the moveable block, the mechanical linkage moving the moveable block based on a selected position.

7. The drill rod handling system of claim 6, wherein the mechanical linkage includes a plurality of selection positions corresponding to the columns.

8. The drill rod handling system of claim 7, wherein the mechanical linkage includes a selection lever and a biased latch, the biased latch engaging a selection position, whereby the mechanical linkage cannot move between selection positions until the biased latch activated.

9. The drill rod handling system of claim 8, wherein the selection lever and the biased latch each includes a handle which when moved toward one another activates the biased latch.

10. A horizontal directional drilling machine, comprising:

a) a drill rod storage magazine having a plurality of generally vertical columns;

b) a boring assembly defining a drill string axis comprising a rack frame with an upper end and a lower end, a gearbox configured to travel along the rack frame from the upper end to the lower end, and a vise assembly at the lower end;

c) a drill rod transfer mechanism configured to move transversely relative to the drill string axis to receive drill pipe from the storage magazine;

d) an operator station;

e) a plurality of stops mounted on the drill transfer mechanism, the plurality of stops being offset from one another and each of which are positioned such that the rod transfer mechanism unloads drill rod from one of the vertical columns; and f) a moveable block which selectively engages one of the stops, wherein the moveable block is positioned into alignment with a stop to select drill rod from a desired vertical column.

11. The horizontal directional drilling machine of claim 10, wherein there is one stop corresponding to each vertical column and the stops are offset vertically from one another.

12. The horizontal directional drilling machine of claim 11, wherein the moveable block moves between vertically offset positions such that it is aligned with one of the stops in each of its positions.

13. The horizontal directional drilling machine of claim 10, further comprising a mechanical linkage connected to the moveable block, the mechanical linkage moving the moveable block based on a selected position and extending to the operator station.

14. The horizontal directional drilling machine of claim 13, wherein the mechanical linkage includes a plurality of selection positions corresponding to the vertical columns.

15. The horizontal directional drilling machine of claim 14, wherein the mechanical linkage includes a selection lever and a biased latch, the biased latch engaging a selection position, whereby the mechanical linkage cannot move between selection positions until the biased latch activated.

16. The horizontal directional drilling machine of claim 15, wherein the selection lever and the biased latch each includes a handle which when moved toward one another activates the biased latch.

17. A method for selecting a desired column of a drill rod magazine having a plurality of columns, the magazine of the type utilized on a horizontal directional drilling machine where a drill rod transfer mechanism moves the drill rod from the desired column to a drill string, the method comprising:

a) affixing a plurality of stops on the rod transfer mechanism;

b) locating a moveable block between a number of positions, wherein one stop is engaged in each position; and c) connecting a mechanical linkage to move the block to the desired position.

* * * * *

UNITED STATES PATENT AND TRADEMARK OFFICE

CERTIFICATE OF CORRECTION

PATENT NO. : 7,467,670 B2
APPLICATION NO. : 11/524731
DATED : December 23, 2008
INVENTOR(S) : Hartke et al.

It is certified that error appears in the above-identified patent and that said Letters Patent is hereby corrected as shown below:

Col. 5, line 2: "driven gear 68. Movement of the driven gear 68" should read --driven gear 168. Movement of the driven gear 168--

Col. 5, line 64: "flange 73 and" should read --flange 173 and--

Signed and Sealed this

Thirtieth Day of June, 2009

JOHN DOLL
*Acting Director of the United States Patent and Trademark Office*